US011324290B2

(12) United States Patent
Tsuchida et al.

(10) Patent No.: US 11,324,290 B2
(45) Date of Patent: May 10, 2022

(54) ELEMENT AND SLIDE FASTENER

(71) Applicant: YKK Corporation, Tokyo (JP)

(72) Inventors: Shigeru Tsuchida, Kurobe (JP); Chikako Hiromi, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 17/265,477

(22) PCT Filed: Aug. 6, 2018

(86) PCT No.: PCT/JP2018/029458
§ 371 (c)(1),
(2) Date: Feb. 2, 2021

(87) PCT Pub. No.: WO2020/031239
PCT Pub. Date: Feb. 13, 2020

(65) Prior Publication Data

US 2021/0307458 A1 Oct. 7, 2021

(51) Int. Cl.
*A44B 19/06* (2006.01)
*A44B 19/40* (2006.01)

(52) U.S. Cl.
CPC ..... *A44B 19/06* (2013.01); *A44B 19/403* (2013.01)

(58) Field of Classification Search
CPC ..... A44B 19/06; A44B 19/403
See application file for complete search history.

(56) References Cited

U.S. PATENT DOCUMENTS 1,610,839 A * 12/1926 Winterhalter ..... A44B 19/06 24/411
1,692,196 A * 11/1928 Blair ..... A44B 19/04 24/411
1,745,116 A * 1/1930 Pipes ..... A44B 19/06 24/411
1,864,614 A 6/1932 Poux
2,067,735 A * 1/1937 Silberman ..... A44B 19/403 24/413
2,353,106 A * 7/1944 Winterhalter ..... A44B 19/06 24/414

(Continued)

FOREIGN PATENT DOCUMENTS

BE 355 045 A 11/1928
JP S61-052912 A 4/1986

(Continued)

OTHER PUBLICATIONS

International Search Report, PCT Application No. PCT/JP2018/029458, dated Oct. 23, 2018.

(Continued)

*Primary Examiner* — Jason W San
(74) *Attorney, Agent, or Firm* — Kilpatrick Townsend & Stockton LLP

(57) ABSTRACT

An element includes a head having an engaging convex portion protruding from one surface thereof and an engaging concave portion formed on the back of the engaging convex portion on the other surface; and a pair of leg portions extending from the head. A protrusion is formed on a side of the engaging concave portion close to the leg portions to protrude inward of the engaging concave portion.

5 Claims, 9 Drawing Sheets

(56) References Cited

U.S. PATENT DOCUMENTS

| | | | | | |
|---|---|---|---|---|---|
| 2,628,400 | A * | 2/1953 | Firing | A44B 19/06 | 24/411 |
| 2,727,290 | A * | 12/1955 | Alberto | A44B 19/06 | 24/411 |
| 2,731,671 | A * | 1/1956 | Zimmerman | A44B 19/40 | 264/135 |
| 4,236,683 | A * | 12/1980 | Moertel | A44B 19/06 | 24/411 |
| 4,418,449 | A * | 12/1983 | Heimberger | A44B 19/06 | 24/401 |
| 4,651,388 | A * | 3/1987 | Horikawa | A44B 19/06 | 24/409 |
| 4,654,388 | A | 3/1987 | Horikawa et al. | | |
| 5,394,593 | A * | 3/1995 | Aoki | A44B 19/06 | 24/411 |
| 9,101,182 | B2 * | 8/2015 | Kozato | A44B 19/50 | |
| 2008/0209695 | A1 * | 9/2008 | Matsui | A44B 19/08 | 24/412 |
| 2008/0313867 | A1 * | 12/2008 | Morioka | A44B 19/06 | 24/403 |
| 2009/0013505 | A1 * | 1/2009 | Hasegawa | A44B 19/06 | 24/400 |
| 2011/0010899 | A1 * | 1/2011 | Kozato | A44B 19/06 | 24/409 |
| 2012/0036685 | A1 * | 2/2012 | Wang | A44B 19/06 | 24/399 |
| 2013/0007993 | A1 * | 1/2013 | Kozato | A44B 19/24 | 24/415 |
| 2013/0133161 | A1 * | 5/2013 | Ren | A44B 19/303 | 24/434 |
| 2014/0182092 | A1 * | 7/2014 | Seki | A44B 19/06 | 24/430 |
| 2016/0015133 | A1 * | 1/2016 | Chung | A44B 19/403 | 24/411 |
| 2019/0269207 | A1 * | 9/2019 | Kumei | B21F 45/16 | |

FOREIGN PATENT DOCUMENTS

| | | | |
|---|---|---|---|
| JP | H01-22505 | Y2 | 7/1989 |
| JP | H06-217810 | A | 8/1994 |
| WO | 2011/135699 | A1 | 11/2011 |

OTHER PUBLICATIONS

Written Opinion, PCT Application No. PCT/JP2018/029458, dated Oct. 23, 2018.

Supplementary European Search Report, European Patent Application No. 18929776.5, dated Feb. 17, 2022.

English Translation of the Written Opinion of the International Searching Authority, PCT Patent Application No. PCT/JP2018/029458, dated Oct. 23, 2018.

* cited by examiner

ELEMENT AND SLIDE FASTENER

TECHNICAL FIELD

The present invention relates to a metal element, which is configured to be engaged with or disengaged from another element by moving a slider, and to a slide fastener.

BACKGROUND ART

Conventionally, an element is disclosed, in which a rib is provided on an inner surface of a front end wall of an engaging concave portion formed in an engaging head thereof in order to obtain a strong engagement strength capable of withstanding an external force, such as a crosswise force or a puncturing force (Patent Literature 1).

CITATION LIST

Patent Literature

Patent Literature 1: Japanese Utility Model Publication No. H1-22505

SUMMARY OF INVENTION

Technical Problem

However, since the element described in Patent Literature 1 is provided with the rib on the inner surface of the front end wall of the engaging concave portion, there is a possibility that when, as shown in FIG. 7 of Patent Literature 1, an engaging convex portion of an element on one side climbs over a front end wall of an engaging concave portion of an element on the other side and then engages with the engaging concave portion, the engaging convex portion of the element on the one side interferes with a rib provided on the front end wall of the engaging concave portion of the element on the other side, thereby making a sliding property poor.

An object of the present invention is to provide an element and a slide fastener, which have an improved puncture strength while maintaining a sliding property when engaging elements with each other.

Solution to Problem

An element according to one embodiment of the present invention includes:

a head having an engaging convex portion protruding from one surface thereof and an engaging concave portion formed on a back side of the engaging convex portion on the other surface; and a pair of leg portions extending from the head, wherein a protrusion is formed on a side of the engaging concave portion close to the leg portions to protrude inward of the engaging concave portion.

In the element according to one embodiment of the present invention, a maximum width Wp of the protrusion as measured on a surface and a maximum width Wbox of the engaging concave portion as measured on the surface satisfy a following equation (1):

$$20\% \leq Wp/Wbox \leq 55\% \quad (1)$$

wherein the surface refers to a surface of the element, on which the engaging concave portion is formed.

In the element according to one embodiment of the present invention, a maximum height Hp of the protrusion as measured from a surface and a maximum height Hbox of the engaging concave portion as measured from the surface satisfy a following equation (2):

$$5\% \leq Hp/Hbox \leq 15\% \quad (2)$$

wherein the surface refers to a surface of the element, on which the engaging concave portion is formed.

In the element according to one embodiment of the present invention, an allowable relative rotation angle $\alpha$ between the engaging convex portion and the engaging concave portion in an engaged state satisfies a following equation (3):

$$-30° \leq \alpha \leq 30° \quad (3)$$

wherein $\alpha$ is 0° when distal ends of the heads of two engaged elements are parallel with each other.

A slide fastener according to one embodiment of the present invention includes:

a pair of fastener tapes;

a plurality of the above-described elements each fixed on the pair of fastener tapes; and at least one slider configured to engage or disengage the elements with or from each other when the elements pass therethrough.

Advantageous Effects of Invention

In the element and the slide fastener according to one embodiment of the present invention, it is possible to improve a puncture strength while maintaining the sliding property when engaging elements with each other.

DESCRIPTION OF EMBODIMENTS

Hereinafter, an element 10 and a slide fastener 1 according to embodiments of the present invention will be described in detail with reference to the accompanying drawings.

Figure 1:
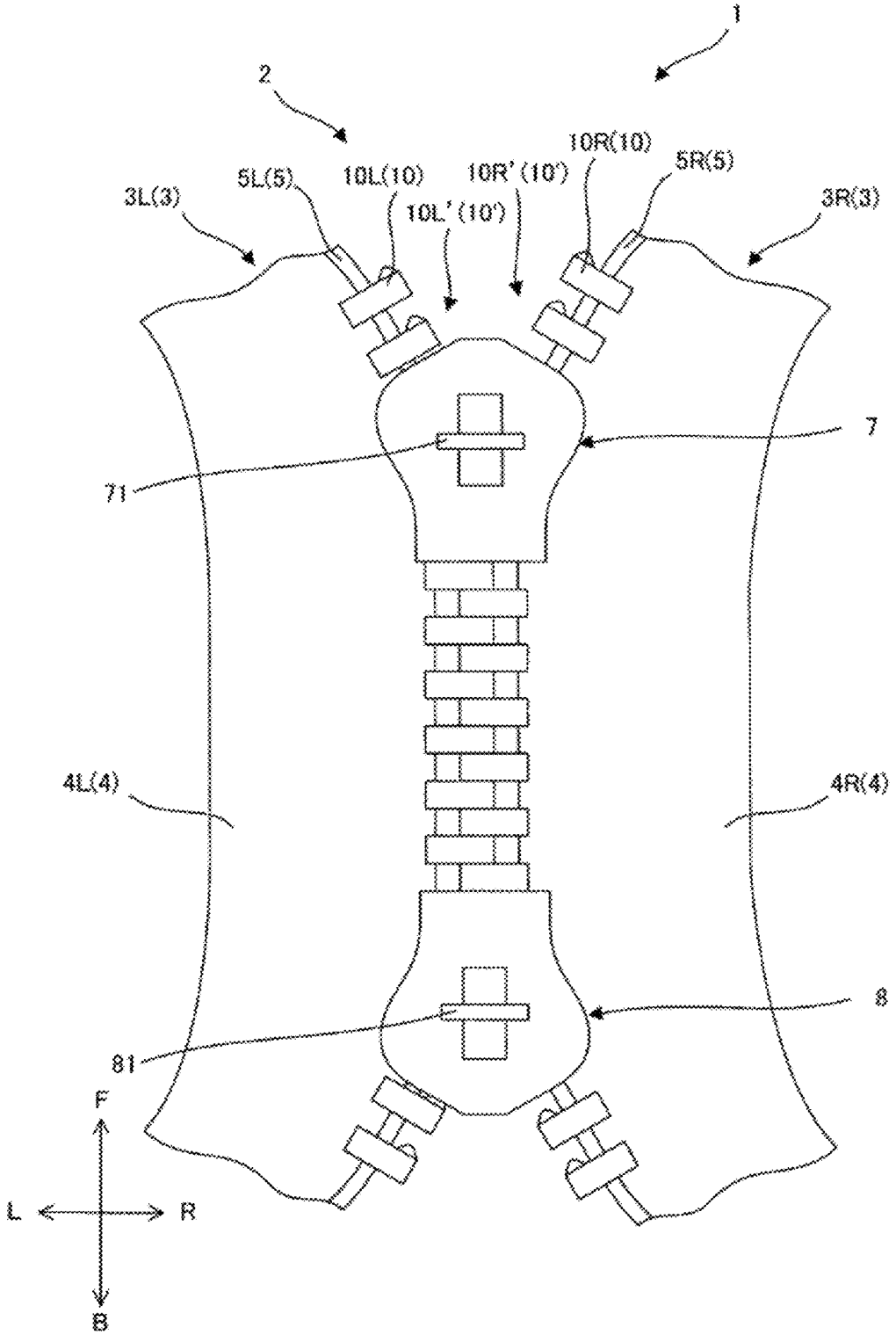
FIG. 1 shows a slide fastener in which an element of the present embodiment is attached.

FIG. 1 shows a slide fastener 1 in which an element 10 of the present embodiment is attached. Meanwhile, in the following embodiments, as shown in FIG. 1, an arrow F represents a forward direction, an arrow B represents a rearward direction, an arrow L represents a left direction, and an arrow R represents a right direction.

The slide fastener 1 illustrated in the present embodiment includes a fastener chain 2 including a first fastener stringer 3L, which has a plurality of first elements 10L fixed on an edge portion 5L of a first fastener tape 4L thereof, and a second fastener stringer 3R, which has a plurality of second elements 10R fixed on an edge portion 5R of a second fastener tape 4R thereof; and a first slider 7 and a second slider 8 configured to slide along the left and right elements 10L, 10R and thus to engage or disengage the left and right elements 10L, 10R with or from each other.

The fastener chain 2 consists of a pair of fastener stringers 3L, 3R. The fastener stringers 3L, 3R have a pair of fastener tapes 4L, 4R and a plurality of elements 10L, 10R fixed on the respective edge portions 5L, 5R of a pair of fastener tapes 4L, 4R at a predetermined pitch. The elements 10L, 10R are arranged to oppose each other.

Also, the first slider 7 and the second slider 8 are inserted through each of the elements 10L, 10R oriented to directions opposite to each other in the forward and rearward direction. That is, the fastener chain 2 of the present embodiment is configured as a two-side-opening type, in which the fastener chain 2 can be opened or closed in the forward and rearward direction. On the other hand, the fastener chain 2 is not limited to the two-side opening type, but may be a one-side-opening type.

In the slide fastener 1 shown in FIG. 1, the elements 10L, 10R of a pair of left and right fastener stringers 3L, 3R of the fastener chain 2 are engaged with each other by moving the first slider 7 in the forward direction as shown by the arrow F, whereas the elements 10L, 10R are disengaged from each other by moving the first slider 7 in the rearward direction as shown by the arrow B. Also, the elements 10L, 10R of the left and right fastener chains 2 are engaged with each other by moving the second slider 8 in the rearward direction as shown by the arrow B, whereas the elements 10L, 10R are disengaged from each other by moving the second slider 8 in the forward direction as shown by the arrow F.

Herein, the forward and rearward direction (F-B direction) is a moving direction of the slider 7 and is also a tape length direction of the fastener tapes 4L, 4R. The left and right direction (L-R direction) as shown by the arrows L, R is a width direction of the fastener tapes 4L, 4R and is also a direction perpendicular to the forward and rearward direction. Also, the left and right direction (L-R direction) is also a direction of a rotation axis of a pull 71 of the slider 7. In addition, an upward and downward direction (U-D direction) not shown in the drawings, which is perpendicular to the paper surface, is a direction perpendicular to tape surfaces of the fastener tapes 4L, 4R.

Figure 2:
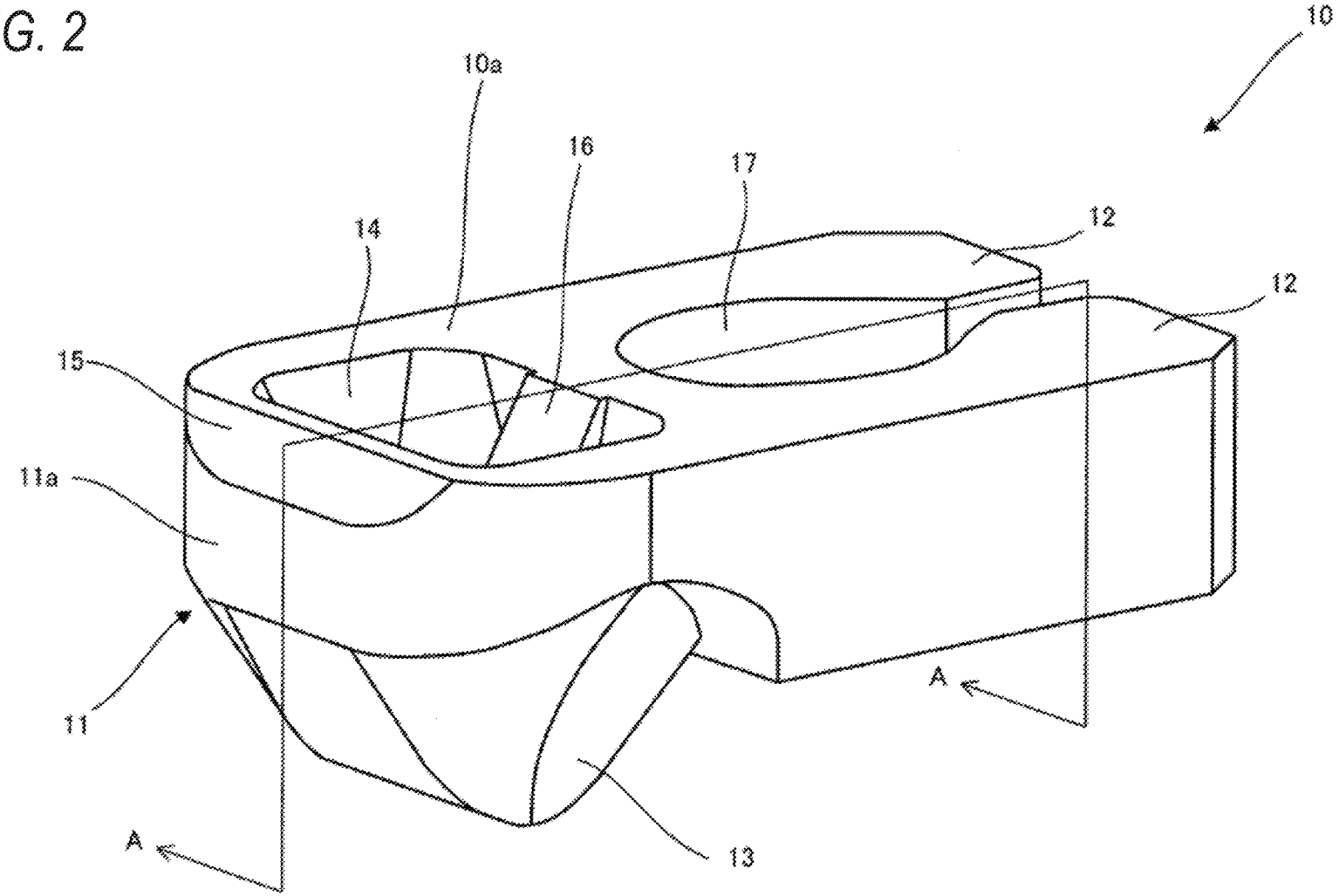
FIG. 2 shows a perspective view of an element according to a first embodiment.
Figure 3:
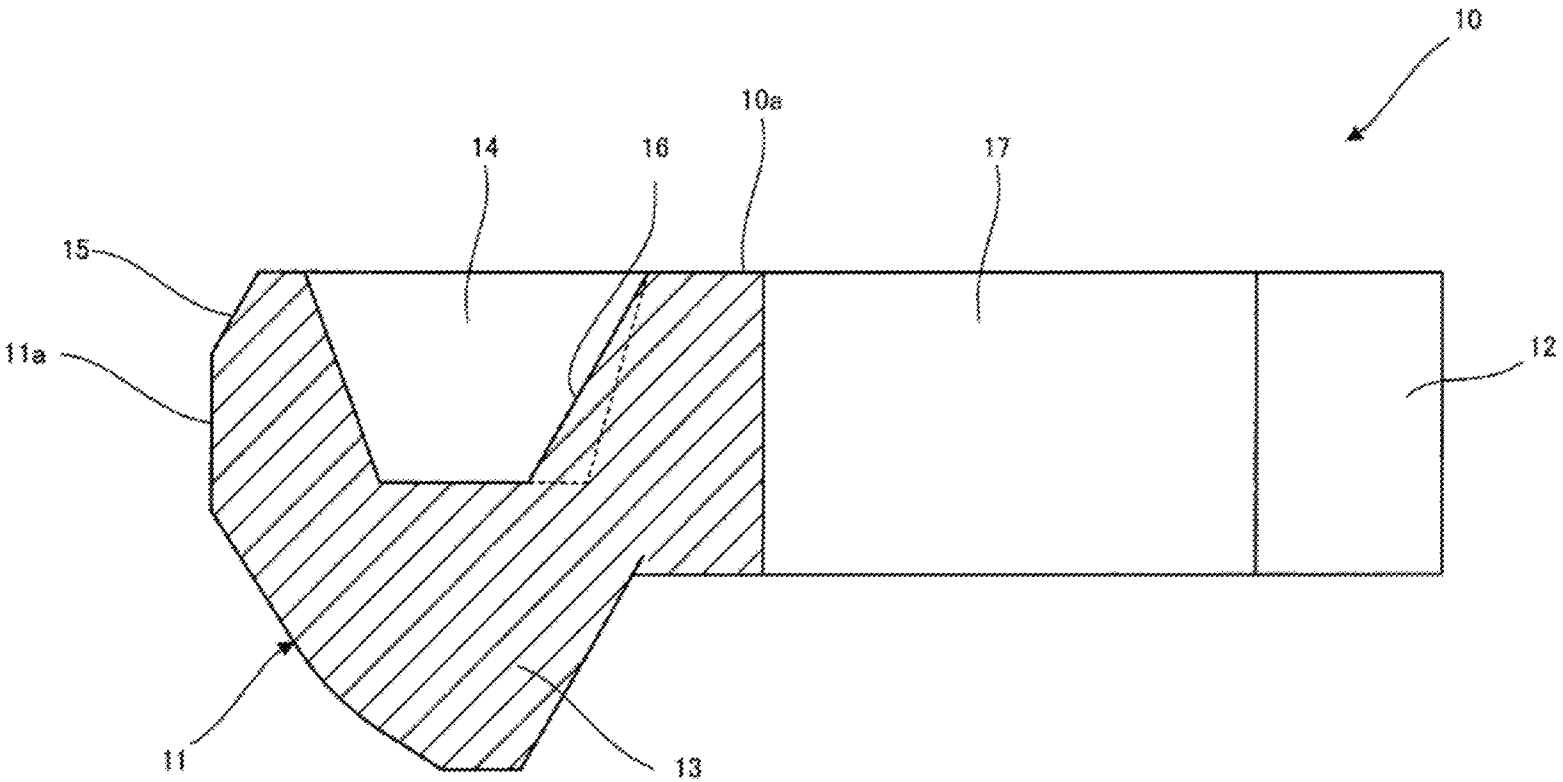
FIG. 3 shows a sectional view of the element according to the first embodiment.
Figure 4:
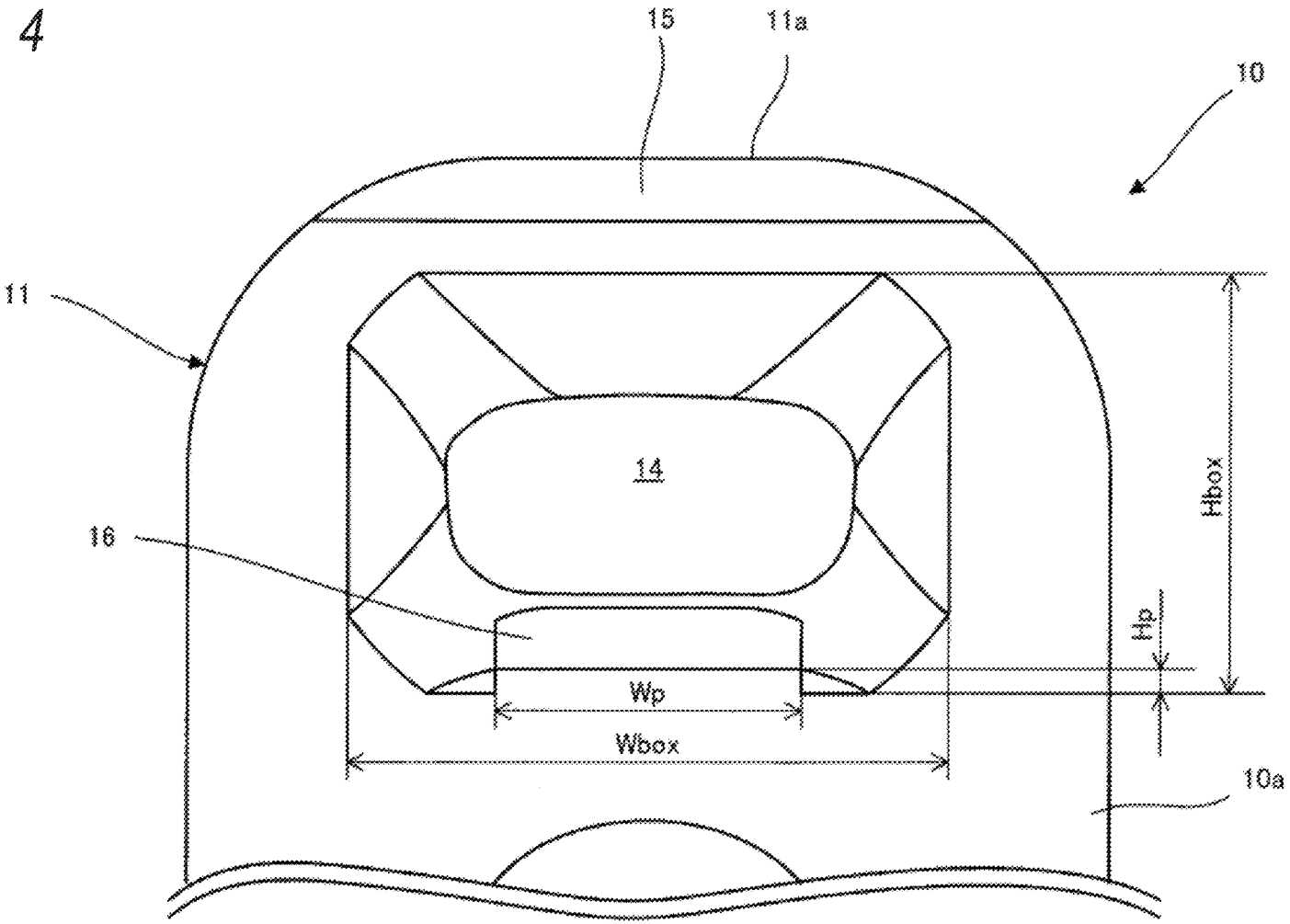
FIG. 4 shows a view of the element according to the first embodiment, as viewed from the side of an engaging concave portion.

FIG. 2 shows a perspective view of the element 10 according to the first embodiment. FIG. 3 shows an A-A sectional view of the element 10 according to the first embodiment. FIG. 4 shows a view of the element 10 according to the first embodiment, as viewed from the side of an engaging concave portion 14.

The element 10 is a metal product manufactured by press working or the like and is used in the slide fastener 1 as shown in FIG. 1. The element 10 includes a head 11 configured to be engaged with another element 10 opposing thereto when the slide fastener 1 has been closed, and leg portions 12 attached to the respective edge portions 5L, 5R of the fastener tapes 4L, 4R.

The head 11 is provided with an engaging convex portion 13 protruding from one surface thereof and an engaging concave portion 14 formed on the other surface. On a surface 10*a* of a distal end 11*a* of the head 11, an inclined portion 15 is formed to facilitate engagement with another element 10 opposing thereto when the element 10 is engaged from the side of the engaging concave portion 14. The inclined portion 15 is formed such that the distal end of the head 11 on the side of the engaging concave portion 14 is chamfered.

The engaging convex portion 13 is formed to be tapered such that a circumferential length thereof becomes shorter as it further protrudes. The engaging concave portion 14 is formed such that the back side of the engaging convex portion 13 is hollowed. Also, the engaging concave portion 14 is formed to be tapered such that a circumferential length thereof becomes shorter as it goes inward. A protrusion 16 is formed on a side of the engaging concave portion 14 close to the leg portions 12. The protrusion 16 is formed to be inclined inward of the engaging concave portion 14 to correspond to the engaging concave portion 14 which is formed to be tapered.

A maximum width Wp of the protrusion 16 as measured on the surface 10*a* and a maximum width Wbox of the engaging concave portion 14 as measured on the surface 10*a* satisfy a following equation (1). Here, the surface 10*a* refers to a surface of the element 10, on which the engaging concave portion 14 is formed.

$$20\% \leq Wp/W\text{box} \leq 55\% \quad (1)$$

Here, Wp is the maximum width of the protrusion 16 as measured on the surface 10*a*, and Wbox is the maximum width of the engaging concave portion 14 as measured on the surface 10*a*.

Further, a maximum height Hp of the protrusion 16 as measured from the surface 10*a* and a maximum height Hbox of the engaging concave portion 14 as measured from the surface 10*a* satisfy a following equation (2). Here, the surface 10*a* refers to a surface of the element 10, on which the engaging concave portion 14 is formed.

$$5\% \leq Hp/H\text{box} \leq 15\% \quad (2)$$

Here, Hp is the maximum height of the protrusion 16 as measured from the surface 10*a* of the engaging concave portion 14 close to the leg portions 12; and Hbox is the maximum height of the engaging concave portion 14 as measured from the surface 10*a* of the engaging concave portion 14 close to the leg portions 12.

Further, it is more preferable that following equations (1') and (2') are satisfied.

$$24\% \leq Wp/W\text{box} \leq 52\% \quad (1')$$

$$5.2\% \leq Hp/H\text{box} \leq 11.5\% \quad (2')$$

The leg portions 12 includes two leg portions 12 extending from the head 11 such that an attachment portion 17, into which the edge portion 5 of the fastener tape 4 is to be fitted, is interposed therebetween. The element 10 is configured to be attached to the fastener tape 4 by fitting the edge portion 5 of the fastener tape 4 into the attachment portion 17 and crimping the two leg portions 12.

Figure 5:
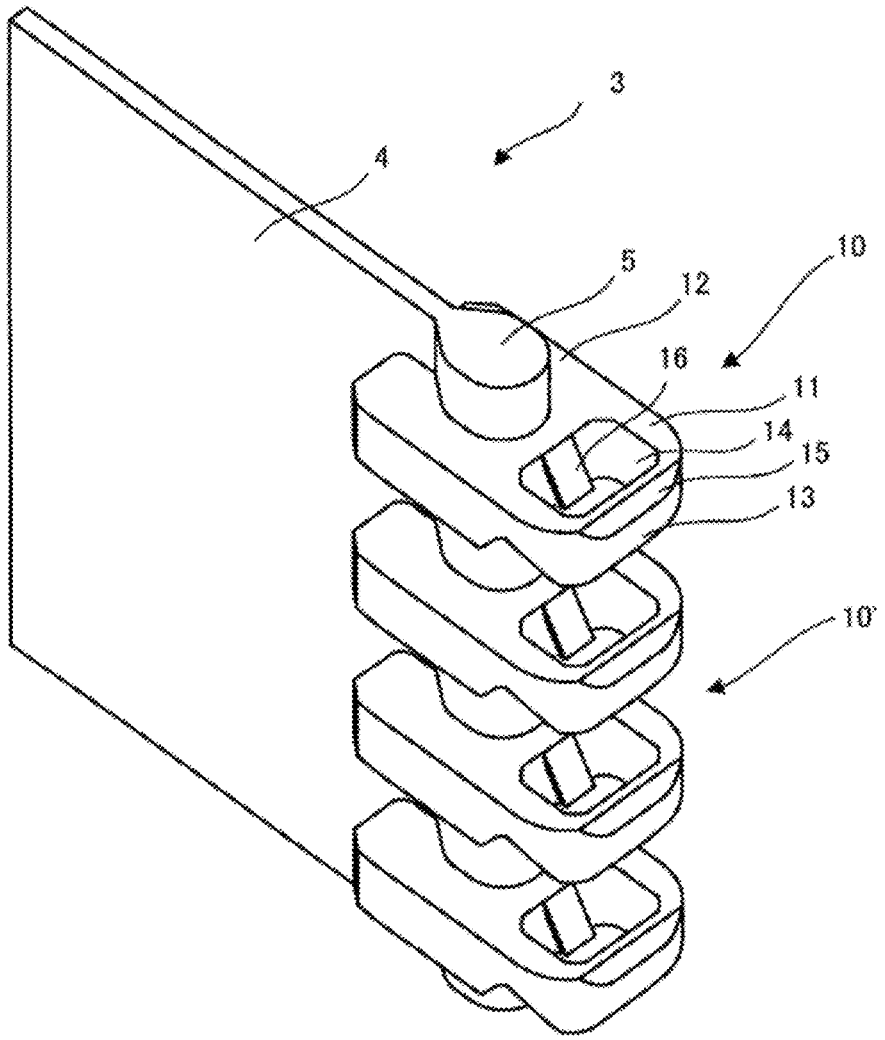
FIG. 5 shows an element row according to the first embodiment.

FIG. 5 shows an element row 10' according to the first embodiment.

As shown in FIG. 5, the element 10 is attached to the edge portion 5 of the fastener tape 4 by crimping the leg portions 12. The element row 10' is preferably formed by arranging a plurality of elements 10 in the same orientation at equal intervals. The interval between the elements 10 is preferably equal to or larger than a thickness of the leg portions 12 of the elements 10.

Figure 6:
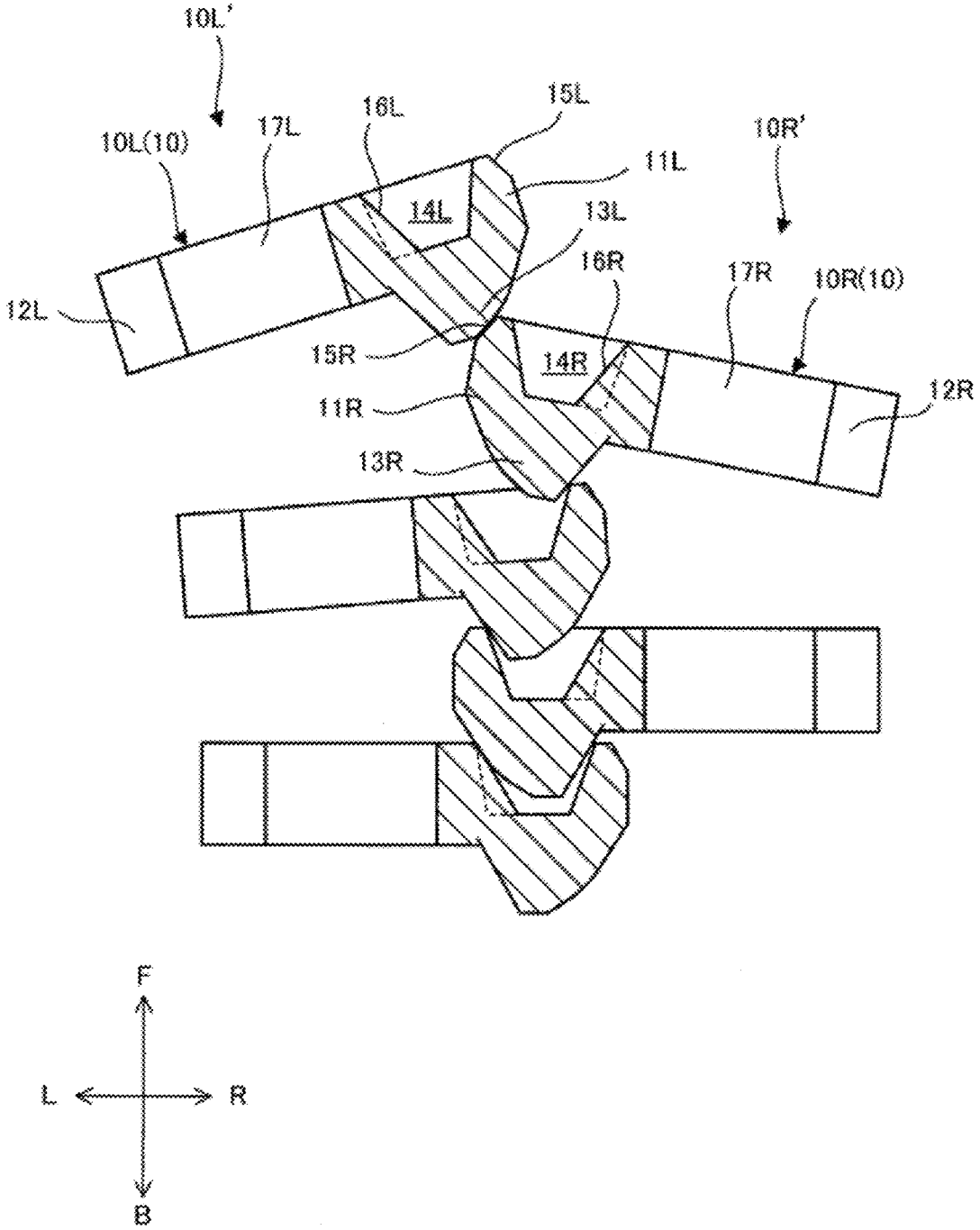
FIG. 6 shows engagement of elements according to the first embodiment.

FIG. 6 shows engagement of the elements 10 according to the first embodiment. However, in FIG. 6, the fastener tapes 4 and the edge portions 5 thereof are omitted.

The element rows 10L', 10R' according to the present embodiment are engaged with each other by moving the slider 7 (see FIG. 1) in the forward direction F and disengaged from each other by moving the slider 7 in the rearward direction B. In the element rows 10L', 10R' of the present embodiment, when a left element 10L is engaged with a right element 10R, the left element 10L and the right element 10R come close to each other and then the engaging convex portion 13L of the left element 10L comes into contact with the inclined portion 15R of the right element 10R. The engaging convex portion 13L of the left element 10L is guided by the inclined portion 15R of the right element 10R to be led into the engaging concave portion 14R of the right element 10R.

Thereafter, the engaging convex portion 13L of the left element 10L is inserted into the engaging concave portion 14R of the right element 10R. The engaging convex portion 13L of the left element 10L enters the engaging concave portion 14R of the right element 10R along a surface thereof opposite to the protrusion 16R. Finally, the left element 10L and the right element 10R are engaged with each other. On the other hand, when a right element 10R is engaged with a left element 10L, it may be deemed such that the left and right sides are in reverse. This operation is repeated for the left elements 10L and the right elements 10R, thereby achieving engagement of the element rows 10L', 10R'.

Since the engaging convex portion 13L of the left element 10L enters the engaging concave portion 14R of the right element 10R along a surface thereof opposite to the protrusion 16R, the protrusion 16R does not interfere with the engaging convex portion 13L, thereby the slider 7 can smoothly slide and also the element rows 10L', 10R' can be accurately engaged with each other.

Figure 7:
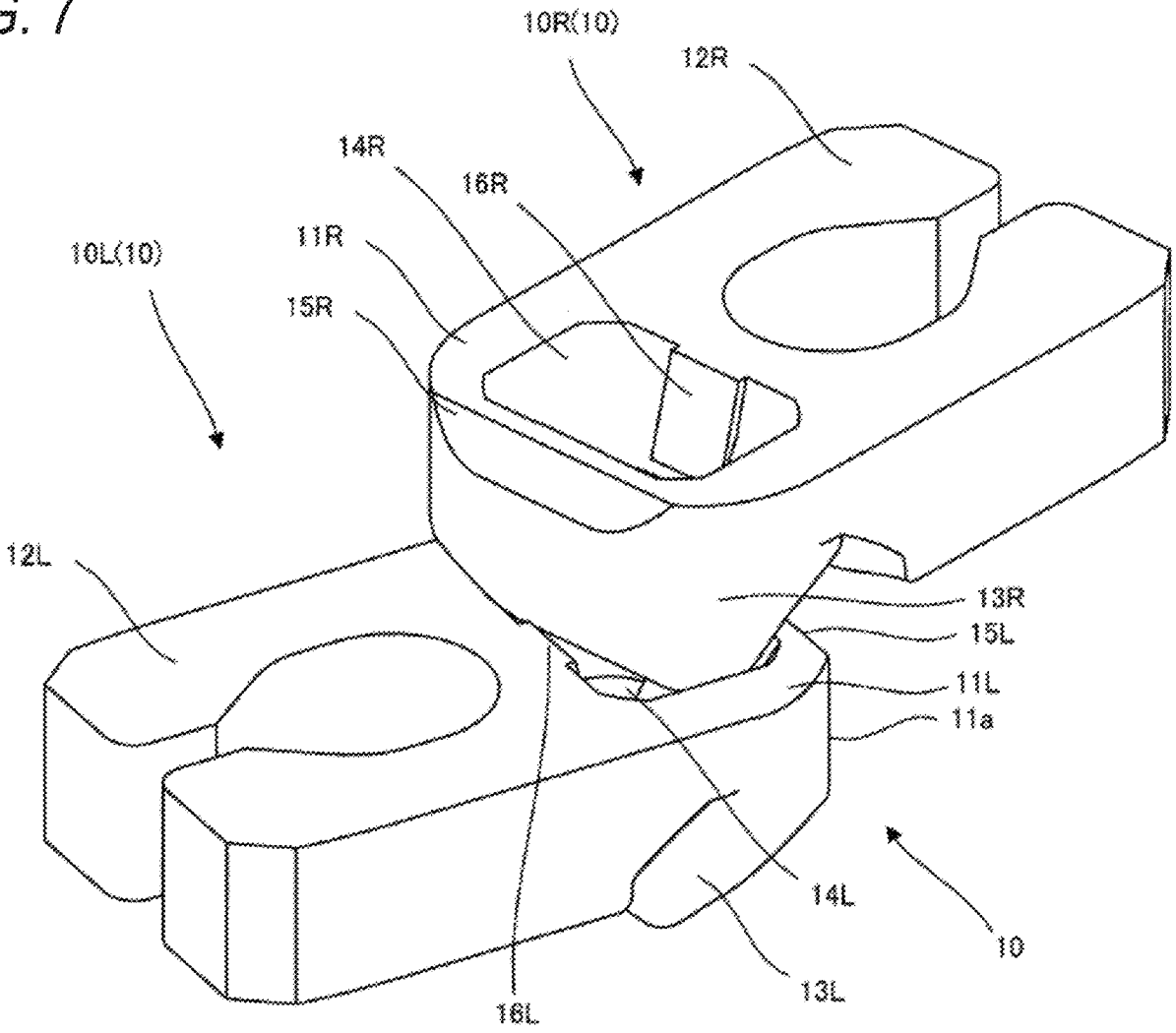
FIG. 7 shows an engaging convex portion and an engaging concave portion rotated relative to each other in a state where the elements according to the first embodiment are engaged with each other.
Figure 8:
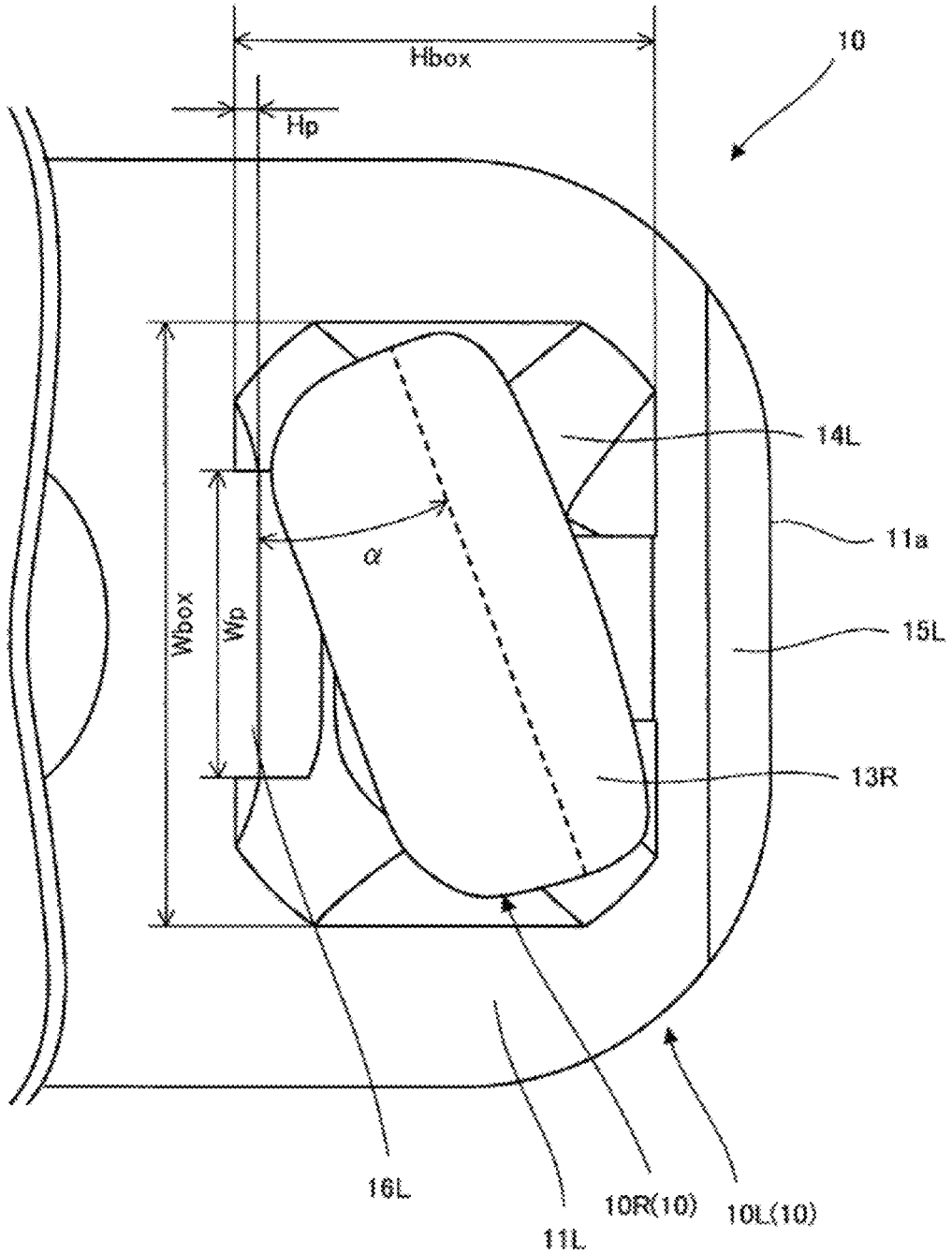
FIG. 8 shows an enlarged sectional view of the engaging convex portion and the engaging concave portion shown in FIG. 7.

FIG. 7 shows the engaging convex portion 13 and the engaging concave portion 14 rotated relative to each other while the elements 10 according to the first embodiment are engaged with each other. FIG. 8 shows an enlarged sectional view of the engaging convex portion and the engaging concave portion shown in FIG. 7.

The left element 10L and the right element 10R according to the present embodiment are formed to be rotatable relative to each other by a predetermined angle in an engaged state. As shown in FIG. 7, an allowable relative rotation angle $\alpha$ satisfies a following equation (3).

$$-30° \leq \alpha \leq 30° \quad (3)$$

Here, $\alpha$ is 0° when the distal ends 11*a* of the heads of the two engaged elements 10 are parallel with each other.

Also, it is preferable that a following equation (3') is satisfied, and it is more preferable that a following equation (3") is satisfied.

$$-25° \leq \alpha \leq 25° \quad (3')$$

$$-20° \leq \alpha \leq 20° \quad (3'')$$

Since the left element 10L and the right element 10R can be rotated relative to each other up to the allowable angle, the slide fastener 1 in which these elements 10 are attached can be easily deformed and thus can be used for many types of products.

When a puncturing force is applied to the left element 10L and the right element 10R in the engaged state, the left element 10L and the right element 10R rotate relative to each other to intersect with each other as shown in FIG. 7. When the allowable relative rotation angle is increased, the engaging concave portion 14L and the protrusion 16L of the left element 10L come into contact with the engaging convex portion 13R of the right element 10R, thereby withstanding the puncturing force. For example, as compared with a case where there is no protrusion, a puncture strength is increased by up to 20%.

Figure 9:
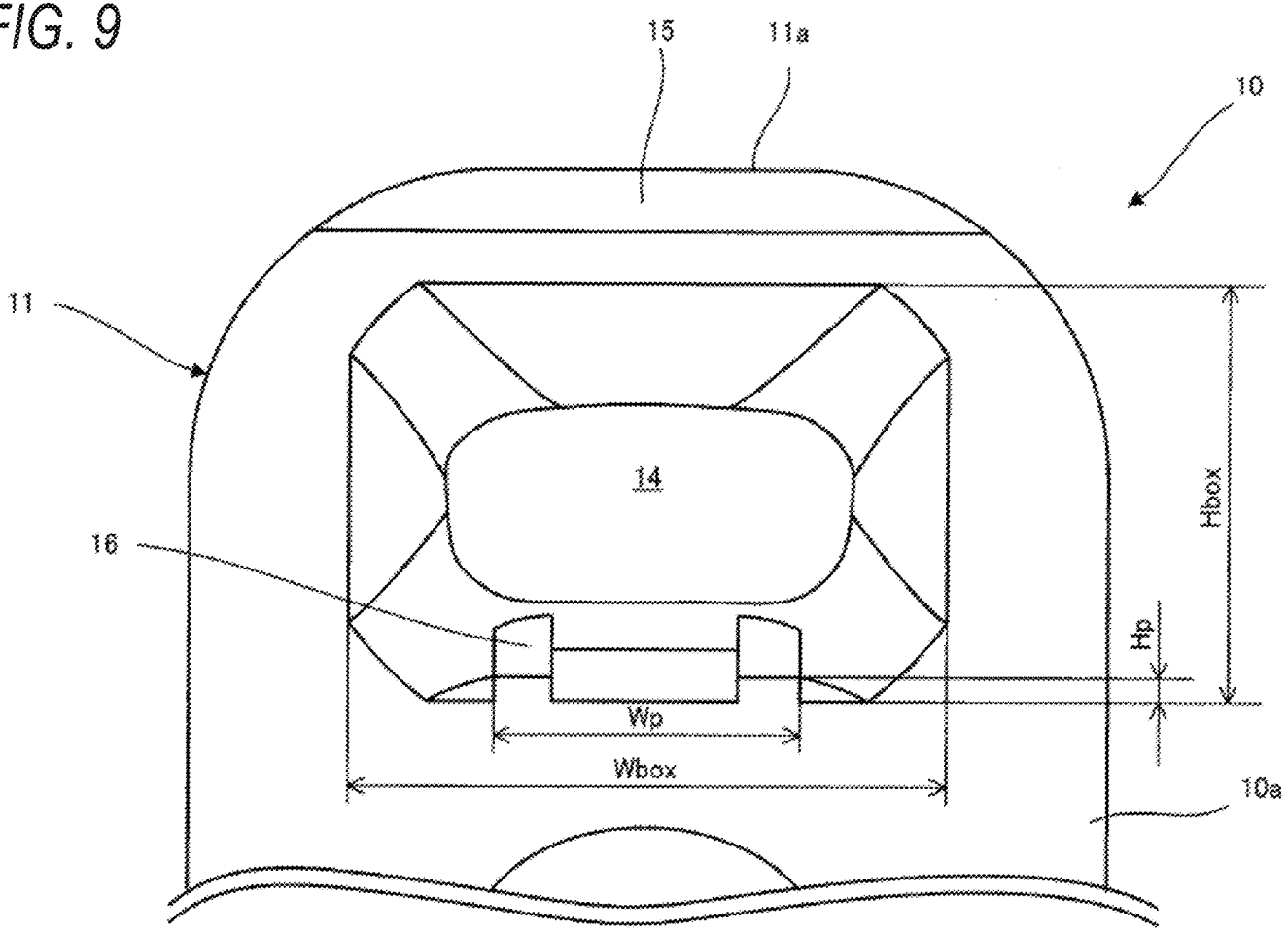
FIG. 9 shows a view of an element according to a second embodiment, as viewed from the side of an engaging concave portion.

FIG. 9 shows a view of the element 10 according to a second embodiment, as viewed from the side of an engaging concave portion 14.

In the element 10 of the second embodiment, two protrusions 16 are formed in the engaging concave portion 14 to be spaced from each other. In this case, a width Wp of the protrusions 16 is a distance from the left side of the left protrusion 16 on the surface 10*a* to the right side of the right protrusion 16 on the surface 10*a*. A maximum width Wp of the protrusions 16 as measured on the surface 10*a* and a maximum width Wbox of the engaging concave portion 14 as measured on the surface 10*a* satisfy the above equation (1). Also, a maximum height Hp of the protrusions 16 as measured from the surface 10*a* and a maximum height Hbox of the engaging concave portion 14 as measured from the surface 10*a* satisfy the above equation (2).

Further, even if the protrusions 16 are formed to be spaced from each other, the relative rotation angle with respect to the engaging convex portion 13 does not change and thus the above equation (3) is satisfied. In addition, it is more preferable that the above equations (1') and (2') are satisfied. Alternatively, three or more protrusions 16 may be provided. In this case, a width Wp of the protrusions 16 is a distance from the left side of the most left protrusion 16 on the surface 10*a* to the right side of the most right protrusion 16 on the surface 10*a*. Further, in this case, a height Hp of the protrusions 16 is a height of the protrusions 16 at both ends as measured from the surface 10*a*.

Alternatively, the element 10 according to the present embodiment may be provided with a protruding portion on a side of the engaging concave portion 14 close to the distal end 11*a*, in addition to the side of the engaging concave portion 14 close to the leg portions 12.

As described above, the element 10 according to the present embodiment includes the head 11 having the engaging convex portion 13 protruding from one surface thereof and the engaging concave portion 14 formed on the back side of the engaging convex portion 13 on the other surface; and the pair of leg portions 12 extending from the head 11, wherein the protrusion 16 is formed on the side of the engaging concave portion 14 close to the leg portions 12 to protrude inward of the engaging concave portion 14. Therefore, it is possible to improve the puncture strength while maintaining the sliding property when engaging the elements 10 with each other.

Also, in the element 10 according to the present embodiment, a maximum width Wp of the protrusion 16 as measured on the surface 10*a* and a maximum width Wbox of the engaging concave portion 14 as measured on the surface 10*a* satisfy the following equation (1).

$$20\% \leq Wp/W\text{box} \leq 55\% \quad (1)$$

Here, the surface 10*a* refers to a surface of the element 10, on which the engaging concave portion 14 is formed.

Therefore, it is possible to further improve the puncture strength while maintaining the sliding property when engaging the elements 10 with each other.

Further, in the element 10 according to the present embodiment, a maximum height Hp of the protrusion 16 as measured from the surface 10*a* and a maximum height Hbox of the engaging concave portion 14 as measured from the surface 10*a* satisfy the following equation (2).

$$5\% \leq Hp/H\text{box} \leq 15\% \quad (2)$$

Here, the surface 10*a* refers to a surface of the element 10, on which the engaging concave portion 14 is formed.

Therefore, it is possible to further improve the puncture strength while maintaining the sliding property when engaging the elements 10 with each other.

Also, in the element 10 according to the present embodiment, an allowable relative rotation angle α between the engaging convex portion 13 and the engaging concave portion 14 in the engaged state satisfies the following equation (3).

$$-30° \leq \alpha \leq 30° \quad (3)$$

Here, α is 0° when the distal ends 11*a* of the heads of the two engaged elements 10 are parallel with each other.

Therefore, the slide fastener 1 employing the element 10 can be easily deformed and thus can be used for many types of products.

Further, the slide fastener 1 according to the present embodiment includes the pair of fastener tapes 4; the plurality of the above-described elements 10 each fixed on the pair of fastener tapes 4; and at least one slider 7 configured to engage or disengage the elements 10 with or from each other when the elements 10 pass therethrough. Therefore, according to the slide fastener 1, it is possible to improve the puncture strength while maintaining the sliding property when engaging the elements 10 with each other.

Although various embodiments of the present invention have been described, the present invention is not limited to the foregoing embodiments, and accordingly, any other embodiments constructed by appropriately combining configurations of the foregoing embodiments are intended to be encompassed by the scope of the invention.

REFERENCE SIGNS LIST

1: Slide fastener
2: Fastener chain
3 (3L, 3R): Fastener stringer
4 (4L, 4R): Fastener tape
5 (5L, 5R): Edge portion
7: First slider
8: Second slider
10 (10L, 10R): Element
11: Head
12: Leg portion
13: Engaging convex portion
14: Engaging concave portion
15: Inclined portion
16: Protrusion
17: Attachment portion

The invention claimed is:

1. An element, comprising:

a head having an engaging convex portion protruding from one surface thereof and an engaging concave portion formed on a back side of the engaging convex portion on the other surface; and a pair of leg portions extending from the head, wherein the engaging concave portion includes a pair of inner surfaces facing each other, a protrusion is formed on one of the inner surfaces which is closer to the leg portions than the other of the inner surfaces, to protrude inward of the engaging concave portion.

2. The element according to claim 1, wherein a maximum width Wp of the protrusion as measured on a surface and a maximum width Wbox of the engaging concave portion as measured on the surface satisfy a following equation:

$$20\% \leq Wp/W\text{box} \leq 55\%$$

wherein the surface refers to a surface of the element, on which the engaging concave portion is formed.

3. The element according to claim 1, wherein a maximum height Hp of the protrusion as measured from a surface and a maximum height Hbox of the engaging concave portion as measured from the surface satisfy a following equation:

$$5\% \leq Hp/H\text{box} \leq 15\%$$

wherein the surface refers to a surface of the element, on which the engaging concave portion is formed.

4. The element according to claim 1, wherein an allowable relative rotation angle α between the engaging convex portion and the engaging concave portion in an engaged state satisfies a following equation:

$$-30° \leq \alpha \leq 30°$$

wherein α is 0° when distal ends of heads of two engaged elements are parallel with each other.

5. A slide fastener, comprising:

a pair of fastener tapes;

a plurality of elements according to claim 1, each element fixed on the pair of fastener tapes; and at least one slider configured to engage or disengage the elements with or from each other when the elements pass therethrough.

* * * * *